US011906223B2

(12) United States Patent
Gopalnarayanan et al.

(10) Patent No.: US 11,906,223 B2
(45) Date of Patent: Feb. 20, 2024

(54) SYSTEMS AND METHODS FOR DETERMINING A FAULT OF AN AIR SYSTEM FOR HEATING, VENTILATION AND/OR COOLING

(71) Applicant: Rheem Manufacturing Company, Atlanta, GA (US)

(72) Inventors: Sivakumar Gopalnarayanan, Plano, TX (US); Ammar K. Sakarwala, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 294 days.

(21) Appl. No.: 17/192,078

(22) Filed: Mar. 4, 2021

(65) Prior Publication Data

US 2022/0282897 A1 Sep. 8, 2022

(51) Int. Cl.
*F25B 49/02* (2006.01)

(52) U.S. Cl.
CPC ..... *F25B 49/02* (2013.01); *F25B 2500/04* (2013.01); *F25B 2500/12* (2013.01); *F25B 2500/13* (2013.01); *F25B 2500/222* (2013.01)

(58) Field of Classification Search
CPC .. F25B 49/02; F25B 2500/04; F25B 2500/12; F25B 2500/13; F25B 2500/222
See application file for complete search history.

(56) References Cited

U.S. PATENT DOCUMENTS

2002/0189433 A1* 12/2002 Unger ..... F02B 71/00 91/361
2016/0282026 A1* 9/2016 Park ..... F24F 11/86
2016/0370045 A1* 12/2016 Takenaka ..... F28D 1/0443
2019/0170603 A1* 6/2019 Gupte ..... F25B 49/005

FOREIGN PATENT DOCUMENTS

EP 3690338 A1 * 8/2020 ..... F24F 11/30

OTHER PUBLICATIONS

Berg, Method and apparatus for preventing component malfunction using accelerometers, 2019, Full Document (Year: 2019).*

* cited by examiner

*Primary Examiner* — Nael N Babaa
(74) *Attorney, Agent, or Firm* — Eversheds Sutherland (US) LLP

(57) ABSTRACT

The disclosed technology includes a method for identifying and determining a fault or a potential fault in an air system having an outdoor unit and an indoor unit in fluid communication via a refrigerant circuit. The method can include receiving, from a sensor, vibration data indicative of one or more sounds or vibrations detected by at least a portion of the refrigerant circuit. The method can include identifying, based at least in part on the vibration data and stored baseline vibration data, an abnormality in the vibration data. The abnormality can be indicated by vibration data indicative of a frequency that is outside a range of acceptable frequencies. The method can include analyzing the identified abnormality according to a predetermined set of evaluation factors to determine the fault or the potential fault.

17 Claims, 4 Drawing Sheets

SYSTEMS AND METHODS FOR DETERMINING A FAULT OF AN AIR SYSTEM FOR HEATING, VENTILATION AND/OR COOLING

FIELD OF THE DISCLOSURE

The present invention relates generally to systems and methods for determining a fault in an air system for heating and/or cooling, and more particularly, to identifying and diagnosing a fault, or a potential fault, in an air system for heating and/or cooling.

BACKGROUND

Commercial buildings, homes, or other structures can commonly be equipped with one or more air systems for heating and/or cooling, such as a heat pump system or an air conditioner system. These air systems can include an indoor unit and an outdoor unit in fluid communication via a refrigerant circuit. During the lifespan of such air systems, faults can occur, which can result in high-energy consumption, poor thermal comfort, and/or unacceptable indoor air quality. For example, the heat exchanger in the indoor unit and/or the outdoor unit can become dirty and blocked from dirt, dust, ice, leave, or other debris. Additionally, a refrigerant leak can occur causing the refrigerant charge to become low. These example faults can negatively impact the ability of the air system to provide heated or cooled air.

To help identify faults and minimize any negative effects that can be experienced by an air system, certain diagnostic tools exist that can identify and determine the fault. Diagnostic tools can assist owners in taking corrective actions to avoid degradation in comfort and air system energy efficiency, thereby leading to potential cost savings. Further, diagnostic tools can assist technicians when performing maintenance by decreasing time and labor cost and minimizing the potential for misdiagnosing faults.

However, these traditional diagnostic tools can have several drawbacks. For example, traditional diagnostic tools can require a sensor to be installed on the indoor unit and thus can require a more cumbersome installation process. Additionally, the sensors can capture temperature and/or pressure data from the air system at a relatively low sampling rate. Such low sampling rate can lead to misdiagnosing a fault (e.g., a false positive, a false negative). Lastly, many traditional diagnostic tools lack the ability to make a prognosis, and thus, an owner is unable to proactively react to a potential fault in the air system.

What is needed, therefore, is an air system that can accurately perform a diagnosis of faults and/or a prognosis of impeding faults and/or potential faults in such air system.

SUMMARY

These and other problems can be addressed by the technologies described herein. Examples of the present disclosure relate generally to an air system for heating and/or cooling configured to identify and determine a fault or a potential fault in the air system, thus, allowing an owner or technician to take necessary corrective or preventive action.

The disclosed technology can include a heating, ventilation, and air-conditioning (HVAC) system including a first heat exchanger in fluid communication with a refrigerant circuit and a second heat exchanger in fluid communication with the refrigerant circuit. The system can include a compressor also in fluid communication with the refrigerant circuit. The system can include a sensor located in, on, or proximate a housing comprising the compressor. The sensor can be configured to detect vibration data, the vibration data being indicative of one or more sounds or vibrations detected via at least a portion of the refrigerant circuit. The system can further include a processor and non-transitory computer-readable medium that stores instructions that, when executed by the processor, can cause the system to receive the vibration data, identify, based at least in part on the vibration data and stored baseline vibration data, an abnormality in the vibration data, wherein the abnormality is indicated by vibration data indicative of a frequency that is outside of a range of acceptable frequencies, and analyze the identified abnormality according to a set of evaluation factors to determine a fault.

The sensor can be a high-frequency sensor.

The sensor can include a microphone configured to detect sounds associated with the system.

The sensor can include an accelerometer configured to detect vibrations associated with the system.

The sensor can be disposed on or proximate the compressor.

The sensor can be disposed on or proximate a conduit of the refrigerant circuit at a location that is between the compressor and the second heat exchanger.

The fault can be one or more of (i) at least a partial blockage of air flow in the first heat exchanger, (ii) at least a partial blockage of air flow in the second heat exchanger, (iii) a leak of refrigerant flowing through the refrigerant circuit, (iv) at least a partial failure of a motor of a fan configured to move air through the housing, or (v) at least a partial failure of a capacitor disposed within the housing.

The first heat exchanger and the second heat exchanger can be located in a single unit.

The predetermined set of evaluation factors can include a first band of frequencies and a second bank of frequencies. The first band of frequencies can be associated with a first fault and the second band of frequencies can be associated with a second fault.

Analyzing the identified abnormality according to the predetermined set of evaluation factors to determine the fault can include determining a difference between the frequency of the identified abnormality and the predetermined range of acceptable frequencies, if the difference is greater than a first threshold, determining the fault will occur in an estimated amount of time, and if the difference is greater than a second threshold, the second threshold being greater than the first threshold, determining the fault is occurring or has occurring.

The processor can be further configured to output display data for display on a display device, the display data being based at least in part on the determined fault.

The disclosed technology can also include a method of determining a fault in a system comprising an outdoor unit and an indoor unit in fluid communication via a refrigerant circuit. The method can include receiving, from a sensor, vibration data, the vibration data being indicative of one or more sounds or vibrations detected via a portion of the refrigerant circuit. The method can include identifying, based at least in part on the vibration data and stored baseline vibration data, an abnormality in the vibration data, wherein the abnormality is indicated by vibration data indicative of a frequency that is outside of a predetermined range of acceptable frequencies. The method can include analyzing the identified abnormality according to a predetermined set of evaluation factors to determine a fault.

The sensor can transmit the vibration data over a predetermined time period.

The sensor can transmit the vibration data a predetermined number of times during a predetermined time period.

The sensor can be located in, on, or proximate the outdoor unit.

The predetermined set of evaluation factors can include a first band of frequencies and a second band of frequencies, the first band of frequencies associated with a first fault and a second band of frequencies associated with a second fault that is different from the first fault.

The stored baseline vibration data can be indicative of no faults in the system, and identifying, based at least in part on the vibration data and stored baseline vibration data, the abnormality in the vibration data can include determining the vibration data is a predetermined amount different than the stored baseline vibration data.

Analyzing the identified abnormality according to the predetermined set of evaluation factors to determine a fault can include determining a difference between the frequency of the identified abnormality and the predetermined range of acceptable frequencies, if the difference is greater than a first threshold, determining the fault will occur in an estimated amount of time, and if the difference is greater than a second threshold, the second threshold being greater than the first threshold, determining the fault is occurring or has occurred.

The method can further include outputting display data for display on a display device, the display data being based at least in part on the determined fault.

The fault can be one or more of (i) at least a partial blockage of air flow in the indoor heat exchanger, (ii) at least a partial blockage in the outdoor heat exchanger, (iii) a leak of refrigerant flowing through the refrigerant circuit; (iii) at least a partial failure of a motor of a fan disposed within the indoor unit or outdoor unit; or (iv) at least a partial failure of a capacitor disposed within the outdoor unit.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1A:
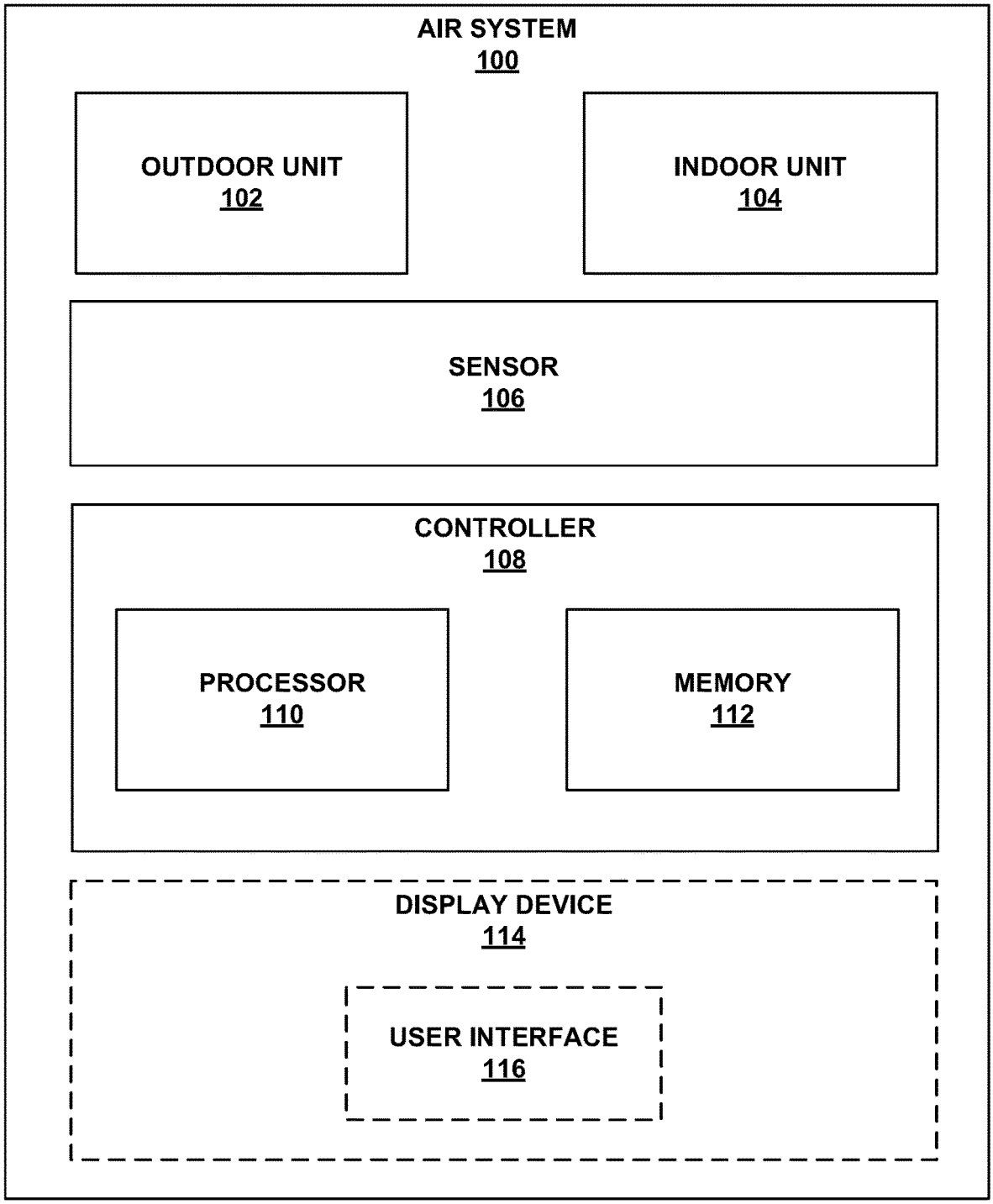
FIG. 1A is a schematic diagram of an example air system configured to identify and determine a fault or a potential fault, in accordance with the disclosed technology.

To facilitate an understanding of the principles and features of the disclosed technology, various illustrative examples are explained below. The disclosed technology can include an air system for heating and/or cooling including an indoor unit having an indoor heat exchanger and an outdoor unit having an outdoor heat exchanger. The indoor heat exchanger and the outdoor heat exchanger can be in fluid communication with a refrigerant circuit. The air system can include a high-frequency sensor located in, on, or proximate the outdoor unit and configured to detect audio waves and/or vibrations (e.g., vibration data) produced or transmitted by the air system or one or more components thereof. The sensor can record such vibration data and transmit the recorded vibration data to a controller having a processor and a memory. The processor can identify an abnormality in the vibration data and analyze such abnormality based on a set of predetermined evaluation factors to determine the fault in the air system. In response, an owner or technician can take any necessary corrective action to avoid degradation in thermal comfort and air system energy efficiency or operability.

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," "one example," "an example," "some examples," "certain examples," "various examples," etc., indicate that the embodiment(s) and/or example(s) of the disclosed technology so described may include a particular feature, structure, or characteristic, but not every embodiment necessarily includes the particular feature, structure, or characteristic. Further, repeated use of the phrase "in one embodiment" or the like does not necessarily refer to the same embodiment, example, or implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween. Further, the expression that a property "can be between approximately 2 and approximately 4" is also inclusive of the endpoints, meaning that the property can be approximately 2, can be approximately 4, or can be any value therebetween.

Referring now to the figures, FIG. 1A is a schematic diagram of an example air system 100 configured to provide an air-heating and/or an air-cooling effect. As used herein, "air system" refers to any system configured to provide heating, ventilation, and/or air conditioning of air (e.g., an HVAC system). The air system 100 can include an outdoor unit 102, an indoor unit 104, a sensor 106, and a controller 108. The controller 108 can include a processor 110 and a memory 112. Optionally, the controller 108 can be configured to communicate with a display device 114. Optionally, the air system 100 can include a user interface 116 or otherwise be configured to receive user input (e.g., from a remote user device).

Figure 1B:
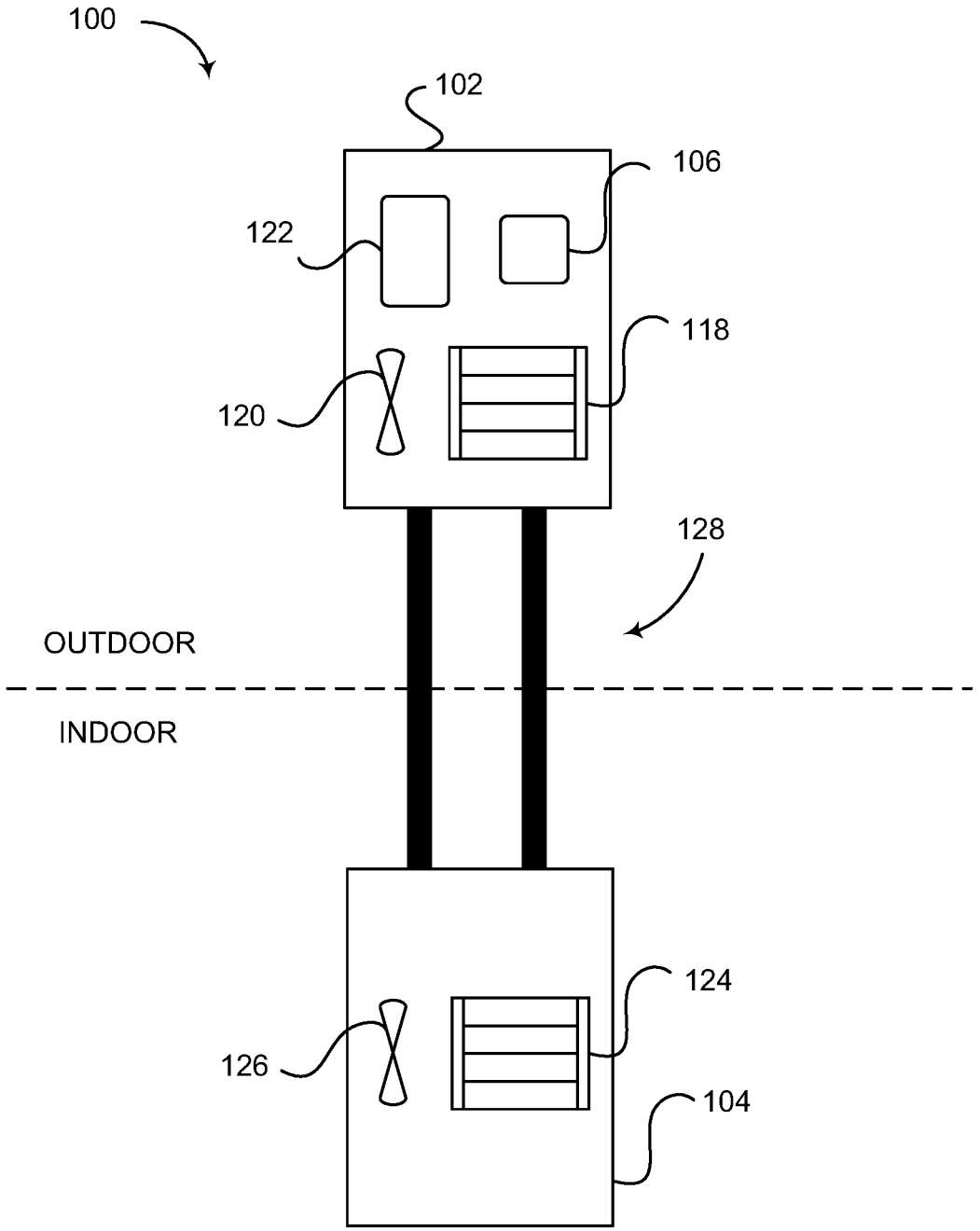
FIG. 1B is a schematic diagram of an outdoor unit and an indoor unit of an example air system, in accordance with the disclosed technology.

FIG. 1B is a schematic diagram of the outdoor unit 102 and the indoor unit 104. The outdoor unit 102 can be positioned or located outside or external to a commercial building, residential structure, or any other structure. The outdoor unit 102 can be positioned at any location where the outdoor unit 102 can receive air from the environment (i.e., an area or space separate from the heated/conditioned space associated with the indoor unit 104). For example, the outdoor unit 102 can be positioned on the ground proximate the structure. As another example, the outdoor unit 102 can be positioned on the rooftop of the structure. The outdoor unit 102 can include an outdoor heat exchanger 118. An outdoor fan 120 can be disposed proximate the outdoor heat exchanger 118. The outdoor fan 120 can draw ambient air from the external environment and across the outdoor heat exchanger 118. The outdoor unit 102 can include a compressor 122. Optionally, the compressor 122 can be configured to operate at variable speeds (e.g., the compressor 122 can be inverter-driven).

The indoor unit 104 can be disposed within the structure. The indoor unit 104 can include an indoor heat exchanger 124. An indoor fan 126 can be disposed proximate the indoor heat exchanger 124. The indoor fan 126 can draw ambient interior air across the indoor heat exchanger 124 to provide an air-heating or air-cooling effect within an interior area of the structure.

The various components of the outdoor unit 102 and the indoor unit 104 can be in fluid communication via a refrigerant circuit 128. The refrigerant circuit 128 can include one or more conduits configured to direct refrigerant through the air system 100, and particularly between the outdoor heat exchanger 118, the compressor 122, and the indoor heat exchanger 124.

The air system 100 can be configured to provide an air-cooling effect to the interior area of the structure (e.g., an air conditioner system or a heat pump system operating in a cooling mode). In such a configuration, the outdoor heat exchanger 118 can function as a condenser and the indoor heat exchanger 124 can function as an evaporator. Further, in such a configuration, high-pressure vapor refrigerant can flow from the compressor 122 to the outdoor heat exchanger 118 via the refrigerant circuit 128. As the high-pressure vapor refrigerant flows through the outdoor heat exchanger 118, the outdoor fan 120 can draw ambient air from the external environment across the outdoor heat exchanger 118, thereby condensing the high-pressure vapor refringent into a high-pressure liquid refrigerant. An expansion valve can be disposed within the refrigerant circuit between the outdoor heat exchanger 118 and the indoor heat exchanger 124. The expansion valve can transition the high-pressure liquid refrigerant into low-pressure liquid refrigerant. The low-pressure liquid refrigerant can flow to the indoor heat exchanger 124 via the refrigerant circuit 128. The indoor fan 126 can draw ambient air from the interior area across the indoor heat exchanger 124. The ambient air from the interior area can be warmer than the low-pressure liquid refrigerant flowing through the indoor heat exchanger 124, thereby the low-pressure liquid refrigerant can remove the heat from the ambient air. As the heat from the ambient air is removed, the air in the interior area can become cooler, resulting in the air-cooling effect. The low-pressure liquid refrigerant can be directed back to the compressor 122 of the outdoor unit 102 via the refrigerant circuit 128 such that the cycle can repeat.

Alternatively, or in addition, the air system 100 can be configured to provide an air-heating effect. Optionally, the air system 100 can include a reversing valve disposed within the refrigerant circuit 128 (or some other reversing component or configuration) that can allow the air system 100 to reverse the flow of refrigerant through the refrigerant circuit 128 to transitioning the air system 100 between a cooling mode and a heating mode. When the air system 100 is configured to provide the air-heating effect (i.e., operating in the heating mode), the outdoor heat exchanger 118 can function as an evaporator and the indoor heat exchanger 124 can function as a condenser. Further, in such a configuration, the reversing valve can direct high-pressure vapor refrigerant from the compressor 122 to the indoor heat exchanger 118 via the refrigerant circuit 128. As the high-pressure vapor refrigerant flows through the indoor heat exchanger 124, the indoor fan 126 can draw ambient air from the interior area across the indoor heat exchanger 124, thereby causing the high-pressure vapor refrigerant to condense into high-pressure liquid refrigerant. The ambient air can remove heat from the high-pressure vapor refrigerant flowing through the indoor heat exchanger 124, thereby providing the air-heating effect. The expansion valve disposed within the refrigerant circuit 128 can transition the high-pressure liquid refrigerant into low-pressure liquid refrigerant. The low-pressure liquid refrigerant can flow to the outdoor heat exchanger 118 via the refrigerant circuit 128, and back to the compressor 122 such that the cycle can repeat.

The sensor 106 can be configured to detect local vibration data from the air system 100. By way of example, the sensor 106 can be configured to detect audio waves and/or vibrations transmitted by various components of the air system 100. The sensor 106 can include a microphone such that the sensor 106 can detect audio waves and/or can determine the frequencies of audio waves. Alternatively or in addition, the sensor 106 can include an accelerometer such that the sensor 106 can detect vibrations and/or can determine the frequencies of vibration. (Alternatively, the sensor 108 can detect vibrations and/or waveforms, and a separate component, such as the controller 108, can determine the frequencies of the vibrations and/or waveforms.) The sensor 106 can be a high-frequency sensor. As a non-limiting example, the sensor 106 can have a sampling rate of approximately 4 kHz. Alternatively, the sensor 106 can have a sampling rate of greater than 4 kHz. Such sampling rate can improve the accuracy of the collection of vibration data, including the audio and/or vibration frequency data, as compared to traditional temperature and pressure sensors that can have a sampling rate of approximately 1 Hz.

The sensor 106 can be positioned at various locations within the air system 100. The sensor 106 can be coupled to or positioned proximate any component directing refrigerant through the refrigerant circuit. As schematically illustrated in FIG. 1B, the sensor 106 can be coupled to or positioned proximate the outdoor unit 102. Positioning the sensor 106 at a location on, in, or proximate the outdoor unit 102 can provide relatively easy installation of the sensor 106 by a technician or owner. By way of example, the sensor 106 can be coupled to or positioned proximate a shell of the compressor 122. Optionally, the sensor 106 can be coupled to or positioned proximate a refrigerant conduit of the refrigerant circuit 128. By way of example, the sensor 106 can be coupled to or positioned proximate a discharge refrigerant conduit extending from the compressor 122 and configured to direct refrigerant from the compressor 122 to the indoor heat exchanger 124. Optionally, the sensor 106 can be positioned at or near a center of the outdoor unit 102. Optionally, the sensor 106 can be positioned at or near a base of the outdoor unit 102, an external surface of the of the outdoor unit 102, an internal surface of the outdoor unit 102 (e.g., on the interior side of the external casing of the outdoor unit 102). Optionally, the sensor 106 can be coupled to or positioned proximate the expansion valve disposed within the refrigerant circuit 128 between the outdoor heat exchanger 118 and the indoor heat exchanger 124. Optionally, the sensor 106 can be coupled to or positioned proximate the reversing valve. Optionally, the sensor 106 can be coupled to or positioned proximate a motor of the outdoor fan 120 or the indoor fan 126.

Although FIGS. 1A and 1B depict only one sensor 106, it is contemplated that the air system 100 can include any number of sensors. By way of example, the air system 100 could include a first sensor configured to detect audio frequency and a second sensor configured to detect vibration frequency.

The controller 108 can be a computing device having a processor 110 and a memory 112. The controller 108 can be configured to send and receive wireless or wired signals, and the signals can be analog or digital signals. The wireless signals can include Bluetooth™, BLE, WiFi™, ZigBee™, infrared, microwave radio, or any other type of wireless communication as may be appropriate for the particular application. The hard-wired signal can include any directly wired connection between the controller 108 and the other components. For example, the controller 108 can have a hard-wired 24 VDC connection to various components. Alternatively, the components can be powered directly from a power source and receive control instructions from the controller 108 via a digital connection. The digital connection can include a connection such as an Ethernet or a serial connection and can utilize any appropriate communication protocol for the application such as Modbus, fieldbus, PROFIBUS, SafetyBus p, Ethernet/IP, or any other appropriate communication protocol for the application. Furthermore, the controller 108 can utilize a combination of wireless, hard-wired, and analog or digital communication signals to communicate with and control the various components. One of skill in the art will appreciate that the above configurations are given merely as non-limiting examples and the actual configuration can vary depending on the application.

The memory 112 can be a non-transitory computer readable medium that stores instructions, that when executed by the processor 110 cause the controller 108 to perform certain actions, such as those described herein. The memory 112 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques described herein can be implemented as a combination of executable instructions and data within the memory 112.

Optionally, the controller 108 can be configured to communicate with a display device 114. The display device 114 can be configured to display data, instructions, and the like to an owner, user, or technician. The display device 114 can be integrated into a housing with the controller 108 or installed remotely from the controller 108. If the display device 114 is installed remotely from the controller 108, the display device 114 can be in wired or wireless communication with the controller 108. Optionally, the display device 114 can be a remote device (e.g., a user's mobile device or other handheld device) that is in communication with the controller 108 (e.g., directly, via one or more networks).

Optionally, the display device 114 can include a user interface 116 for displaying information pertaining to the air system 100 and receiving inputs from an owner, user, or technician. By way of example, a technician can input data pertaining to the installation date of the air system 100 or one or more components of the air system 100, maintenance dates of the air system 100 and/or one or more components of the air system 100, or any relevant information pertaining to the air system 100 or the components thereof.

The controller 108 can be in electrical communication with the sensor 106 and can receive signals transmitted by the sensor 106. By way of example, the controller 108 can receive vibration data detected and transmitted by the sensor 106 and can process such vibration data to determine a fault or a potential fault in the air system 100 as further discussed herein.

Figure 2:
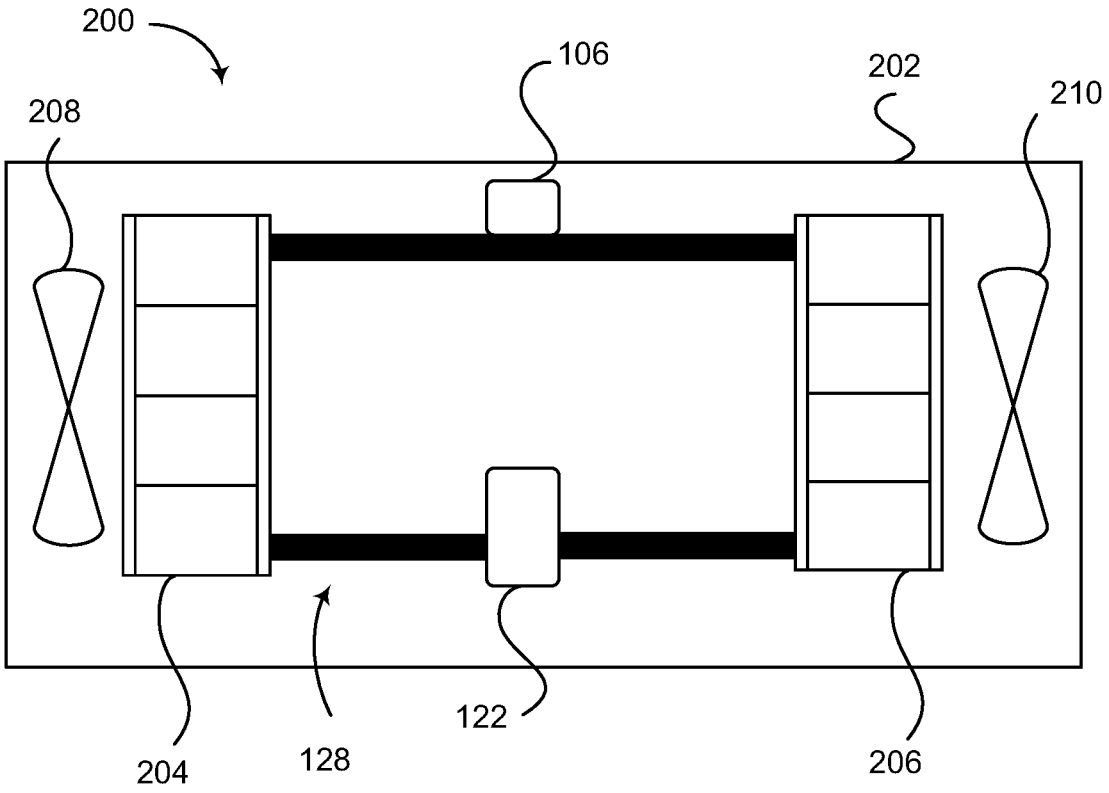
FIG. 2 is a schematic diagram of an additional example air system having a unit including a first heat exchanger and a second heat exchanger, in accordance with the disclosed technology.

Alternatively or in addition, as illustrated in FIG. 2, an example system 200 can include a unit 202 positioned or located outside or external to a home, commercial building, or other structure (e.g., on the ground proximate to the structure or on the rooftop of the structure). The unit 202 can include a first heat exchanger 204 configured to operate as a condenser and a second heat exchanger 206 configured to function as an evaporator. A first fan 208 can be positioned proximate the first heat exchanger 204 to draw ambient air from the external environment and across the first heat exchanger 204. A second fan 210 can similarly be positioned proximate the second heat exchanger 206 to draw ambient air from the external environment across the second heat exchanger 206. The first heat exchanger 204 and the second heat exchanger 206 can be in fluid communication with each other via the refrigerant circuit 128. The unit 202 can further include a compressor 122 and optionally, an expansion valve, such that the system 200 can operate in an air-cooling or air-heating mode. As in the example system 100, the system 200 can include the sensor 106. The sensor 106 can be in electrical communication with the controller 108 as described with reference to FIGS. 1A and 1B. Ductwork can connect the unit 202 to various rooms and/or areas within the interior of the structure. By housing both the first heat exchanger 204 and the second heat exchanger 206, and the associated components thereof, in the unit 202, the "packaged system" can be efficiently manufactured and easily installed.

During the lifespan of the air system 100 various faults can occur or have the potential of occurring. By way of example, the indoor heat exchanger 124 can become at least partially blocked due to dust, dirt, ice, or other accumulated debris, thereby causing air flow to be impeded. Optionally, the outdoor heat exchanger 118 can become at least partially blocked due to dust, direct, snow, ice, or other accumulated debris, thereby causing air flow to be impeded. Accordingly, the system 100 can operate at a higher pressure as compared to the pressure at which the air system 100 can operate when no faults are present. Such higher pressure can potentially cause the compressor 122 to overheat. Optionally, the outdoor fan 120 and/or the indoor fan 126 can weaken over time, thereby impacting performance of the system 100. Similarly, the outdoor fan 120 and/or the indoor fan 126 can fail due to a manufacturing defect resulting in a faulty fan motor or an imbalance in the fan blade load caused by damage. Optionally, the compressor capacitor of the outdoor unit 102 can have a reduction in capacitance over time, thereby impacting performance of the air system 100. Optionally, a fault can occur if the compressor 122 operates while the outdoor fan 120 is not operating, resulting in the compressor 122 potentially overheating. Further, a refrigerant leak can occur in the refrigerant flowing through the refrigerant circuit 128, resulting in low refrigerant charge (e.g., a 90%, 80%, 75%, or other percentage refrigerant charge). Such faults can reduce the efficiency and operability of the air system 100 and require the repair and/or replacement of the air system 100 or components thereof. Accordingly, it can be critical to identify and diagnosis a fault in order to reactively resolve such fault, and optionally, identify a prognosis for a potential or forecasted fault in order to mitigate or prevent such fault.

Figure 3:
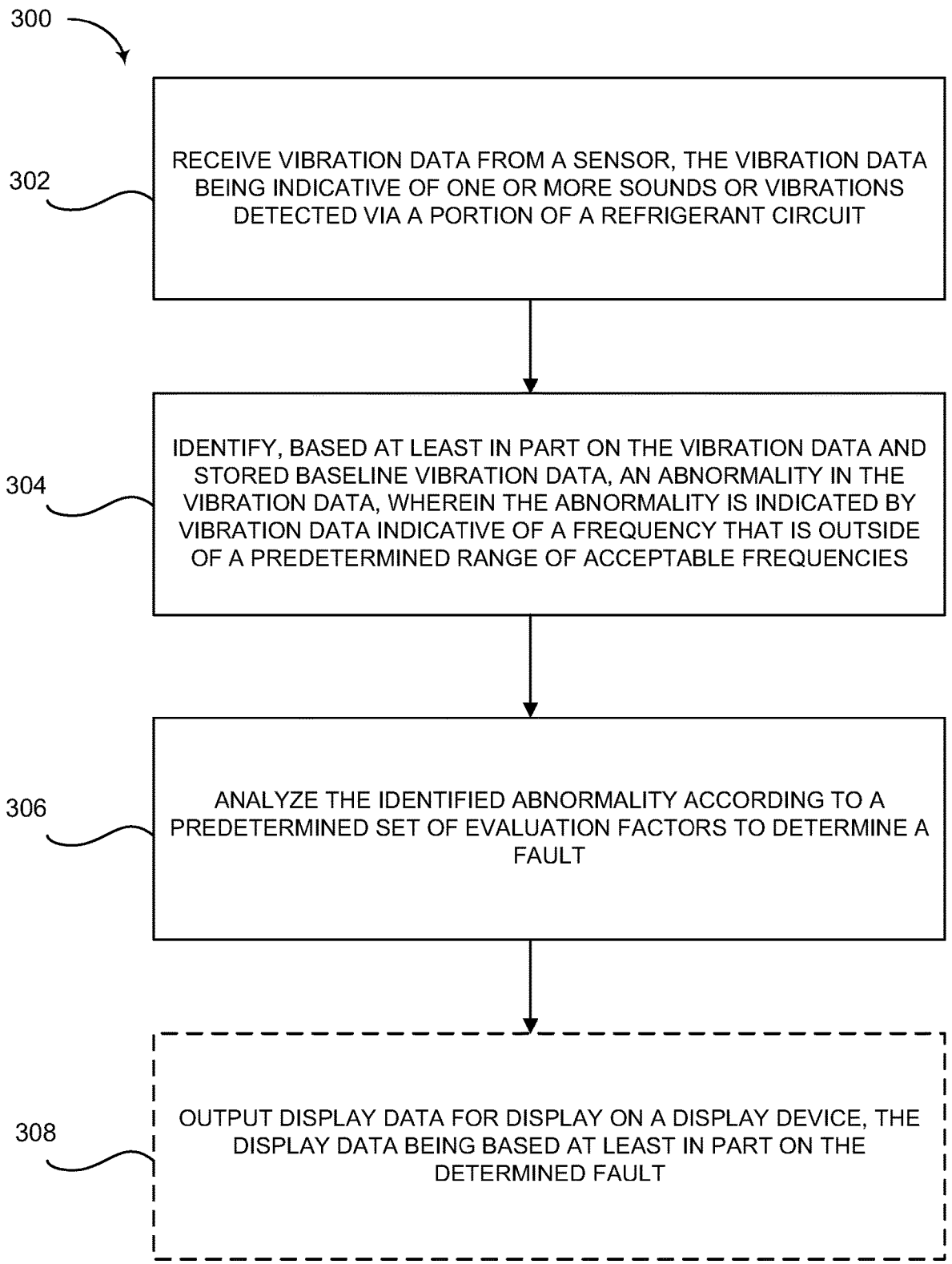
FIG. 3 is a flow diagram outlining an example method of identifying and determining a fault or a potential fault in an air system, in accordance with the disclosed technology.

FIG. 3 illustrates a flow diagram outlining the steps of a method 300 for identifying and determining a fault or a potential fault of the air system 100. The method 300 can include receiving 302 from the sensor 106 vibration data indicative of sounds or vibrations detected via at least a portion of the refrigerant circuit. As discussed above, the sensor 106 can be positioned at various locations within the air system 100. Optionally, the sensor 106 can be positioned on or proximate the outdoor unit 102 or a component thereof. Such placement can allow for easy and quick installation of the sensor 106. The sensor 106 can detect audio waves and/or vibrations produced by the one or more components of the air system 100, including, but not limited to the outdoor unit 102 or the indoor unit 104. The sensor 106 can be configured to record these audio waves and/or vibrations as, for example, vibration data, and transmit the vibration data (e.g., to the controller 108). The sensor 106 can be configured to record the audio waves and/or vibrations for a predetermined period of time and transmit such vibration data to the controller 108 (e.g., the processor 110) a predetermined number of times a day. Alternatively, or in addition, the sensor 106 can record instantaneously occurring audio waves and/or vibrations a predetermined number of times a day and transmit the recorded vibration data a predetermined number of times a day. Alternatively, or in addition, the sensor 106 can record audio waves and/or vibrations every 15 minutes and can transmit the recorded vibration data four times per day. Alternatively, or in addition, the sensor 106 can record audio waves and/or vibrations on an hourly basis and transmit the recorded vibration data also on an hourly basis. Alternatively, or in addition, the sensor 106 can record audio waves and/or vibrations on a daily basis and transmit the recorded vibration data on a weekly basis.

Although specific examples of recording audio waves and/or vibrations produced or transmitted by one or more components of the air system 100 and transmitting the recorded vibration data are discussed above, any frequency of vibration data recording by the sensor 106 is herein contemplated. Similarly, any frequency of transmission of recorded vibration data by the sensor 106 is also herein contemplated. Frequency of recordings and transmission can be adjusted depending on the level of specificity desired.

Optionally, the sensor 106 can amplify and/or filter the vibration data prior to transmitting such recorded vibration data to the controller 108. By way of example, the vibration data can be amplified through a preamplifier to enhance characteristics of the audio waves and/or vibrations (e.g., detected frequencies of the audio waves and/or vibrations), and thus, facilitate accurate processing of the vibration data. The vibration data can be filtered to remove any extraneous noise. By way of example, the vibration data can be filtered to remove any extraneous noise not associated with a fault or potential fault of the air system 100 and/or background noise. Optionally, the pre-amplified, filtered vibration data can be further amplified to enhance certain characteristics of the audio waves and/or vibrations to facilitate accurate processing of the acoustic.

A fault and/or a potential fault (e.g., when conditions are likely to give rise to a fault within a predetermined or approximate period of time) can cause changes in the refrigerant mass flow, 2-phase boundaries, and/or changes in the flow regime of the refrigerant being directed through the refrigerant circuit 128. By way of example, when the outdoor heat exchanger 118 and/or indoor heat exchanger 124 is blocked from dust, dirt, ice, or other debris, air flow can be impeded. If the air system 100 is operating in an air-cooling mode, a blocked outdoor heat exchanger 118 can cause the refrigerant condensing pressure to increase and/or a blocked indoor heat exchanger 124 can cause the refrigerant evaporating pressure to decrease, thereby impacting the refrigerant mass being compressed by the compressor 122. Accordingly, the overall refrigerant mass flowing through the refrigerant circuit 128 can be affected. Further, when the outdoor fan and/or indoor fan is faulty and/or has weakened over time, air flow can be impeded. The reduction in air flow can similarly impact the refrigerant mass being compressed by the compressor 122, and accordingly, the overall refrigerant mass flowing through the refrigerant circuit 128 can be affected. As an additional example, a refrigerant leak can occur at the indoor heat exchanger 124. Such refrigerant leak can impact the discharge pressure of the compressor 122 and can reduce the outdoor heat exchanger 118 capacity. Accordingly, the evaporating pressure can be impacted, and thus, the overall refrigerant mass flowing through the refrigerant circuit 128 can be affected.

If there are faults (or potential/forecasted faults) in the air system 100, the audio and/or vibration frequencies produced by components of the air system 100 can change. For example, faults or potential faults can affect the audio and/or vibration frequencies of components of the air system 100 that direct and/or carry refrigerant. As discussed above, the sensor 106 can detect such audio and/or vibration frequencies and transmit such audio and/or vibration frequencies to the controller as vibration data for further processing as discussed herein. By comparing the detected vibration data to baseline vibration data (which is indicative of vibrations when there are no faults are present in the air system 100 and/or is indicative of vibrations when there are faults present in the air system 100), it can be determined whether the detected vibration data includes abnormalities, and such abnormalities can be indicative of a fault or a potential fault. By way of example, if the baseline vibration data is indicative of no faults and the recorded vibration data is a predetermined amount different from the baseline vibration data, then it can be determined that an abnormality in the recorded vibration data is present. For example, if the baseline data is indicative of no faults and the recorded vibration data is at least 10%, 20%, 50%, 100% or any other predetermined percentage different from the baseline vibration data, then it can be determined that an abnormality in the recorded vibration data is present. Alternatively or in addition, if a predetermined percentage of the recorded vibration data is different from the baseline vibration data by a predetermined percentage, then it can be determined that an abnormality in the recorded vibration data is present. For example, if at least 51% of the recorded vibration data is different from the baseline vibration data by at least 25%, then it can be determined that an abnormality in the recorded vibration data is present. If the baseline vibration data is indicative of a fault or faults and/or a potential fault or potential faults and the recorded vibration data is substantially similar to the baseline vibration data by a predetermined amount, then it can be determined that an abnormality in the recorded vibration data is present. For example, if the baseline vibration data is indicative of a fault or a potential fault and the recorded vibration data is less than 50%, 40% 25% 10%, 1% or any other predetermined percentage different than the baseline vibration data, it can be determined that an abnormality in the recorded vibration data is present. Alternatively or in addition, if the baseline vibration data is indicative of a fault or a potential fault, and a predetermined percentage of the recorded vibration data is less than a predetermined percentage different from the baseline vibration data, then it can be determined that an abnormality in the recorded vibration data is present. For example, if at least 51% of the recorded vibration data is different from the baseline vibration data by less than 10%, then it can be determined that an abnormality in the recorded vibration data is present. The method 200 can include identifying 304, by the controller 108, such abnormality. The abnormality can be indicated by the transmitted audio and/or vibration data indicating a frequency that is outside a predetermined range of acceptable frequencies. For example, the audio and/or vibration frequencies produced by components of the air system 100 can increase when a fault or potential fault exists, such that the abnormality can be indicated by a frequency that exceeds the predetermined range of acceptable frequencies. The transmitted audio and/or vibration frequency data can include a plurality of abnormalities, and the method 200 can include identifying each of the plurality of abnormalities.

Optionally, the disclosed methods (e.g., method 300) and/or systems (e.g., air system 100) can utilize artificial intelligence (AI) and/or machine learning (ML) techniques. For example, the disclosed air system 100 can constantly (or periodically) receive, update, and evolve based on new information, and/or the disclosed method 200 can include some or all of the same steps. The air system 100 can constantly take in data. In such an example, the abnormality determination can simply be a single data point in time that can update and evolve based on new information (e.g., new vibration data, user-inputted identification data). The air system 100 can additionally use AI and ML techniques to update the timing estimation or prediction of faults. While certain methods are described herein, the disclosure is not intended to be so limited. Rather, the methods can be supplemented with other steps (e.g., weights given to certain parameters) and/or can be updated and evolved by the AI and ML techniques as the air system 100 takes in new data.

The method 300 can include analyzing 306, by the controller 108, the identified abnormality according to a predetermined set of evaluation factors to identify the fault. For example, the memory 114 can store the predetermined set of evaluation factors used to analyze the identified abnormality. Optionally, a user and/or technician can use the user interface 116 to input information associated with the predetermined set of evaluation factors and/or the set of evaluation factors themselves. The predetermined set of evaluation factors can include specific bands of audio and/or vibration frequencies associated with each of the various faults or potential faults of the air system 100. By way of example, a first band of audio and/or vibration frequencies can be associated with a first fault and a second band of audio and/or vibration frequencies can be associated with a second fault, where the first fault and the second fault can be different. The first band of audio and/or vibration frequencies can be different from the second band of audio and/or vibration frequencies. Alternatively, the first band of audio waves and/or vibrations can at least partially overlap the second band of audio waves and/or vibrations. If the abnormality is indicative of a frequency within the first band, it can be determined that the air system 100 is experiencing the first fault. If the abnormality is indicative of a frequency within the second band, it can be determined that the air system 100 is experiencing the second fault. The predetermined set of evaluation factors can include any number of frequencies or bands of frequencies associated with any number of faults.

Alternatively or in addition, the predetermined set of evaluation factors can include a plurality of bands of audio and/or vibration frequencies. For example, the first band of audio and/or vibration frequencies can be associated with a first threshold. The first threshold can be indicative of a potential fault that over time could give rise to a fault. For example, the first threshold can be indicative of a predetermined percent charge of refrigerant (e.g., 99%, 98%, 95%, or any other predetermined percent charge of refrigerant). Such predetermined percent charge of refrigerant can be indicative of a decrease in human comfort (e.g., the interior of a structure is not heating and/or cooling properly). Alternatively or in addition, the first threshold can be indicative of a predetermined percentage blockage of air flow (e.g., 2%, 5%, 10%, or any other predetermined percentage blockage of air flow) as compared to an air system 100 with no faults or potential faults operating with 0% blockage of air flow. The predetermined set of evaluation factors can further include a second threshold. The second threshold can be indicative of a potential fault of greater severity than the potential fault indicated by the first threshold. By way of example, the second threshold can be indicative of a predetermined percent charge of refrigerant that is lower than the first threshold (e.g., 94%, 92%, 90%, or any other predetermined percent charge of refrigerant). Such predetermined percent charge of refrigerant can be indicative of an even greater decrease in human comfort (e.g., the interior of a structure is not heating and/or cooling properly) as compared to the first threshold. Alternatively or in addition, the second threshold can be indicative of a predetermined percent blockage of air flow that is greater than the first threshold (e.g., 5%, 10%, 20% or any other predetermined percent blockage of air flow). Accordingly, such second threshold can be indicative of a more severe blockage of air flow as compared to the first threshold. The predetermined set of evaluation factors can further include a third threshold. The third threshold can be indicative of a fault (e.g., the potential fault indicated by the first threshold and the second threshold has become a fault in the air system 100). The third threshold can be indicative of a predetermined percent charge of refrigerant that is lower than the first threshold and the second threshold (e.g., 90%, 80%, 75%, or any other predetermined percent charge of refrigerant). When the identified abnormality corresponds to or is greater than the third threshold value, it can be determined the air system 100 has a fault, such fault likely being a refrigerant charge leak. Alternatively or in addition, the third threshold can be indicative of a predetermined percent blockage of air flow that is greater than the first threshold and the second threshold (e.g., 10%, 25%, 50%, or any other predetermined percent blockage of air flow. When the identified abnormality corresponds or is greater than the third threshold value, it can be determined the air system 100 has a fault, such fault likely being a blockage of air in the outdoor heat exchanger 118 and/or indoor heat exchanger 124 and/or a faulty or defective outdoor fan 120 and/or indoor fan 126.

Optionally, analyzing 306 an identified abnormality need not include comparing the identified abnormality to a set of evaluation factors. Accordingly, any identified abnormality (e.g., any identified difference between recorded vibration data and baseline vibration data as discussed herein) is considered a fault or potential fault of the air system 100.

Optionally, if the identified abnormality is indicative of a fault in the air system 100, the controller 108 can output a signal to at least one component of the air system 100 to cease operation. Accordingly, further damage to the air system 100 can be mitigated and/or prevented and appropriate remedial actions can be taken.

Analyzing the identified abnormality according to the predetermined set of evaluation factors can further include determining a difference between the frequency of the identified abnormality and the predetermined range of acceptable frequencies. If the difference is greater than a first threshold, the controller 108 can determine that the fault will occur in an estimated amount of time. By way of example, the controller 108 can determine the fault will occur in approximately one week, one month, six months, or one year. Accordingly, such determination can be a prognosis of the fault and can provide an owner or technician the opportunity to take proactive corrective action. If the difference is greater than a second threshold, that is greater than the first threshold, the processor 110 can determine that the fault has occurred or is occurring. According, such determination can be a diagnosis of the fault and can allow an owner or technician to take reactive corrective action.

Optionally, artificial intelligence based at least in part on one or more algorithms can be used to analyze the identified abnormality to determine a fault and/or determine an estimated amount of time until a fault occurs. For example, the controller 108 (e.g., memory 112) can store one or more algorithms and upon the controller 108 receiving the transmitted vibration data, the controller 108 (processor 110) can execute the algorithm in order to analyze the abnormality and identify the corresponding fault and/or determine an estimated amount of time until such corresponding fault occurs.

Optionally, the method 300 can include outputting 308 display data for display on the display device 114. The display data can be based on the determined fault. The display data can include details of the fault, an estimated location of the fault, whether the fault has or is occurring, and/or an estimated amount of time until such fault occurs. The display data can be outputted for display on a corresponding device or component, such as the display device 114 and/or a user device (e.g., a computer, a mobile device). The display device 114 can be associated with a user (e.g., owner of the air system 100). Alternatively or in addition, the display device 114 can be associated with the manufacturer or third party provider of the air system 100. Optionally, the display data can include recommended and/or preventive actions to take in response to the detection of the fault or potential fault. The display data can include technician and/or manufacturer contact information such that, based on the display data, a user can contact the appropriate person to take the necessary steps to resolve the fault or potential faults. Accordingly, by detecting a potential fault, the user can ensure the appropriate steps are taken in order to prevent such fault from occurring. Optionally, the display data can include further information pertaining to various technicians and/or manufacturers capable of performing the recommended corrective and/or preventing actions, including pricing, upcoming availability, ratings from past engagements, and the like. Optionally, the user interface 116 of the display device 114 can include selectable graphical inputs (e.g., graphical buttons and/or icons capable of being pressed, tapped, or clicked). A user can use such selectable graphical inputs to initiate a call, chat, or message with a technician or manufacturer when the display data indicates a fault or potential fault is present in the air system 100. A user can further use such selectable graphical inputs to initiate a scheduling request with a technician or manufacturer when the display data indicates a fault is present in the fluid storage tank 102. When a technician services the air system 100 for a fault or potential fault, the technician can use the display data indicating the fault or potential fault and/or estimated amount of time until a fault or potential fault of greater severity occurs to efficiently and effectively perform all necessary maintenance tasks.

When the display device 114 is associated with the manufacturer or a third party provider of the air system 100, the manufacturer or third party provider can receive data from a plurality of users regarding each user's air system 100. Accordingly, the manufacturer or third party provider can collect and analyze data on the air system 100. For example, the manufacturer or third party provider can collect and analyze data to determine estimate lifespan of the air system 100 or components thereof, common faults under particular conditions, and the like. Additionally, if the display data on the display device 114 indicates a potential fault or a fault in the air system 100, the manufacturer or third party provider can promptly contact the user of such air system 100 and facilitate scheduling of maintenance.

Optionally, the method 300 can include outputting a signal to the alarm system 112 to produce a notification in response to the air system 100 detecting a fault or a potential fault. The notification can be text-based and/or an audible sound. In response to the notification, a user can perform the necessary maintenance tasks and/or contact a technician to perform such tasks.

Although the method 300 is discussed with respect to the example air system 100, it is contemplated the method 300 can be similarly used with respect to the example air system 200, as illustrated in FIG. 2.

By diagnosing or prognosing a fault in the air system 100, 200 as described above, an owner or technician can take corrective or preventive action. By way of example, the owner or technician can repair or replace the air system 100, 200 or a component thereof, which can result in the air system 100, 200 operating efficiently and as intended, thereby providing energy and cost savings. Similarly, a technician can use such method 300 of diagnosing or prognosing a fault in the air system 100, 200 during maintenance calls, which can decrease the length of time for a maintenance call, thereby providing time and cost savings for the technician. Further, the method 300 can reduce and/or minimize the likelihood of the technician misdiagnosing a fault of the air system 100, 200.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

What is claimed is:

1. A heating, ventilation, and air-conditioning (HVAC) system comprising:

a first heat exchanger in fluid communication with a refrigerant circuit;

a second heat exchanger in fluid communication with the refrigerant circuit;

a compressor in fluid communication with the refrigerant circuit;

a sensor located in or on a housing comprising the compressor, wherein the sensor is configured to detect vibration data, the vibration data being indicative of one or more sounds or vibrations detected via at least a portion of the refrigerant circuit;

a processor; and a non-transitory computer-readable medium that stores instructions that, when executed by the processor, cause the system to:

receive the vibration data;

identify, based at least in part on the vibration data and stored baseline vibration data, an abnormality in the vibration data, wherein the abnormality is indicated by vibration data indicative of a frequency that is outside of a predetermined range of acceptable frequencies;

determine a difference between the frequency of the identified abnormality and the predetermined range of acceptable frequencies;

if the difference is greater than a first threshold, determine the fault will occur in an estimated amount of time; and if the difference is greater than a second threshold, the second threshold being greater than the first threshold, determine the fault is occurring or has occurred.

2. The HVAC system of claim 1, wherein the sensor is a high-frequency sensor.

3. The HVAC system of claim 1, wherein the sensor includes an accelerometer configured to detect vibrations associated with the system.

4. The HVAC system of claim 1, wherein the sensor is disposed on the compressor.

5. The HVAC system of claim 1, wherein the sensor is disposed on a conduit of the refrigerant circuit at a location that is between the compressor and the second heat exchanger.

6. The HVAC system of claim 1, wherein the fault is at least one or more of: (i) at least partial blockage of air flow in the first heat exchanger; (ii) at least partial blockage of air flow in the second heat exchanger; (iii) a leak of refrigerant flowing through the refrigerant circuit; (iv) at least a partial failure of a motor of a fan configured to move air through the housing; or (v) at least a partial failure of a capacitor disposed within the housing.

7. The HVAC system of claim 1, wherein the first heat exchanger and the second heat exchanger are located in a single unit.

8. The HVAC system of claim 1, wherein the predetermined set of evaluation factors includes a first band of frequencies and a second band of frequencies, the first band of frequencies being associated with a first fault and a second band of frequencies being associated with a second fault.

9. The HVAC system of claim 1, wherein the processor is further configured to output display data for display on a display device, the display data being based at least in part on the determined fault.

10. A method of determining a fault in a system comprising an outdoor unit and an indoor unit in fluid communication via a refrigerant circuit, the method comprising:

receiving, from a sensor, vibration data, the vibration data being indicative of one or more sounds or vibrations detected via a portion of the refrigerant circuit;

identifying, based at least in part on the vibration data and stored baseline vibration data, an abnormality in the vibration data, wherein the abnormality is indicated by vibration data indicative of a frequency that is outside of a predetermined range of acceptable frequencies;

determining a difference between the frequency of the identified abnormality and the predetermined range of acceptable frequencies;

if the difference is greater than a first threshold, determining the fault will occur in an estimated amount of time; and if the difference is greater than a second threshold, the second threshold being greater than the first threshold, determining the fault is occurring or has occurred.

11. The method of claim 10, further comprising recording, by the sensor, the vibration data over a predetermined time period.

12. The method of claim 10, further comprising, transmitting, by the sensor, the vibration data a predetermined number of times during a predetermined time period.

13. The method of claim 10, wherein the sensor is located in or on the outdoor unit.

14. The method of claim 10, wherein the predetermined set of evaluation factors includes a first band of frequencies and a second band of frequencies, the first band of frequencies associated with a first fault and a second band of frequencies associated with a second fault that is different from the first fault.

15. The method of claim 10, wherein the stored baseline vibration data is indicative of no faults in the system, and identifying, based at least in part on the vibration data and stored baseline vibration data, the abnormality in the vibration data comprises determining the vibration data is a predetermined amount different than the stored baseline vibration data.

16. The method of claim 10, further comprising outputting display data for display on a display device, the display data being based at least in part on the determined fault.

17. The method of claim 10, wherein the fault is one or more of: (i) at least partial blockage of air flow in an indoor heat exchanger of the indoor unit; (ii) at least partial blockage of air flow in an outdoor heat exchanger of the outdoor unit; (iii) a leak of refrigerant flowing through the refrigerant circuit; (iv) at least a partial failure of a motor of a fan disposed within the indoor unit or outdoor unit; or (v) at least a partial failure of a capacitor disposed within the outdoor unit.

* * * * *